US008397437B2

(12) United States Patent
Barneman et al.

(10) Patent No.: US 8,397,437 B2
(45) Date of Patent: Mar. 19, 2013

(54) METHOD FOR INSTALLING THE GUIDE RAILS OF AN ELEVATOR AND SYSTEM FOR INSTALLING THE GUIDE RAILS OF AN ELEVATOR

(75) Inventors: Hakan Barneman, Solna (SE); Osmo Björni, Hyvinkää (FI)

(73) Assignee: Kone Corporation, Helsinki (FI)

( * ) Notice: Subject to any disclaimer, the term of this patent is extended or adjusted under 35 U.S.C. 154(b) by 581 days.

(21) Appl. No.: 12/276,252

(22) Filed: Nov. 21, 2008

(65) Prior Publication Data

US 2009/0120734 A1 May 14, 2009

Related U.S. Application Data

(63) Continuation of application No. PCT/FI2007/000141, filed on May 24, 2007.

(30) Foreign Application Priority Data

May 24, 2006 (FI) ..... 20060511

(51) Int. Cl.
*B66B 7/02* (2006.01)

(52) U.S. Cl. ..... 52/30; 52/745.18; 187/408; 187/411

(58) Field of Classification Search ..... 52/30, 741.1, 52/741.3, 745.01–745.05, 745.09–745.12, 52/745.15–745.18

See application file for complete search history.

(56) References Cited

U.S. PATENT DOCUMENTS 2,402,888 A * 6/1946 Hall ..... 33/645
4,040,752 A * 8/1977 Tagnon ..... 356/249
4,106,207 A * 8/1978 Boyett et al. ..... 33/286
4,593,794 A * 6/1986 Russeau ..... 33/404
5,931,264 A * 8/1999 Gillingham et al. ..... 104/127
6,422,352 B1 * 7/2002 Pettersson et al. ..... 187/408
7,562,744 B2 * 7/2009 Mustalahti et al. ..... 187/401
7,654,006 B1 * 2/2010 Mooney ..... 33/286

FOREIGN PATENT DOCUMENTS

JP 6-115851 A 4/1994
JP 6-293482 A 10/1994

* cited by examiner

*Primary Examiner* — Branon Painter
*Assistant Examiner* — Matthew J Smith
(74) *Attorney, Agent, or Firm* — Birch, Stewart, Kolasch & Birch, LLP

(57) ABSTRACT

Method and system for installing the guide rails (1, 2), such as the car guide rails and/or counterweight guide rails, in an elevator shaft (3). The guide rails are installed by assembly in phases starting from the bottom (4) of the elevator shaft by placing one on top of the other guide rail sections ($\mathbf{5}^1$, $\mathbf{5}^2$; $\mathbf{6}^1$, $\mathbf{6}^2$; $\mathbf{7}^1$, $\mathbf{7}^2$ . . . ) that are shorter than the whole length of the guide rail and by aligning the guide rail sections perpendicularly by means of the laser beam produced by a direction laser (8). The direction laser (8) is moved upwards along with progressive assembly of the guide rail. As assembly progresses the direction laser (8) is supported in the proximity of the top end of the topmost vertically aligned guide rail section at the time for aligning the next guide rail section to be installed in the vertical direction. These phases are repeated until the entire guide rail is assembled. The system comprises an alignment appliance (12), which can be supported against a guide rail section and fixed to it by means of a permanent magnet (20). In addition the alignment appliance contains an aligning element (13), at which the laser beam produced by the direction laser can be directed.

21 Claims, 4 Drawing Sheets

Figure 1:
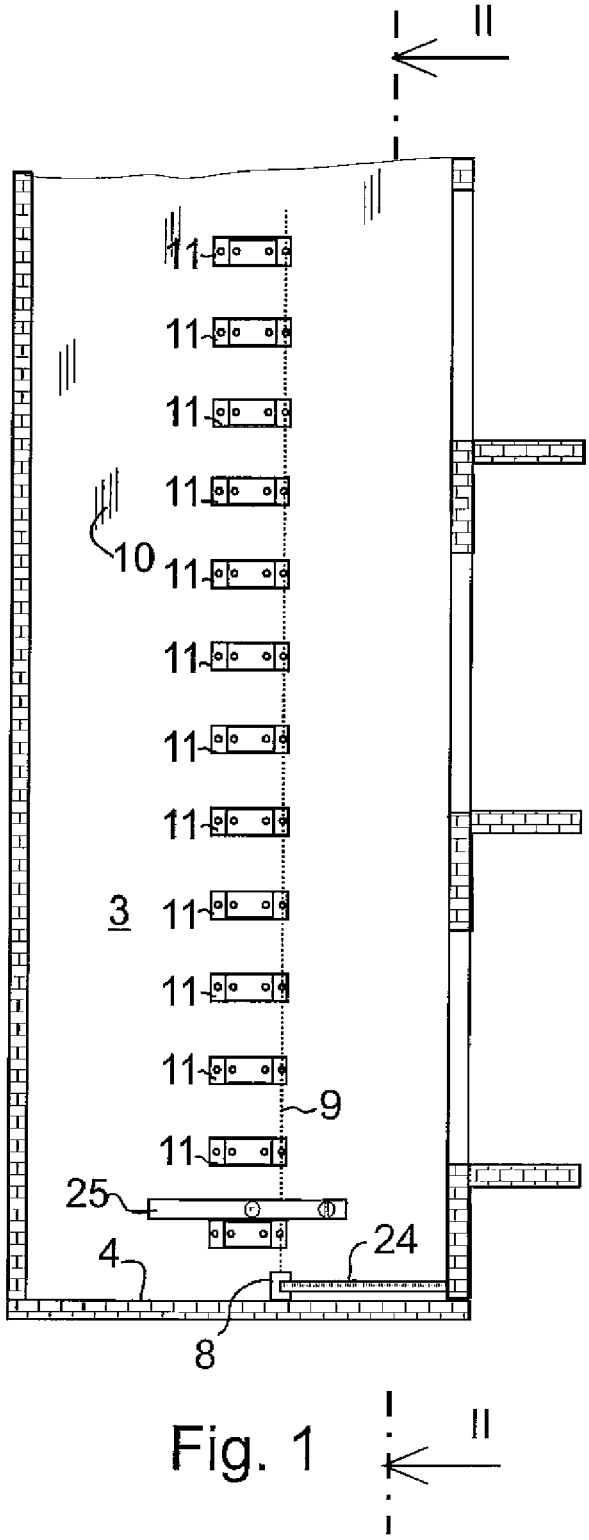

METHOD FOR INSTALLING THE GUIDE RAILS OF AN ELEVATOR AND SYSTEM FOR INSTALLING THE GUIDE RAILS OF AN ELEVATOR

This application is a Continuation of copending PCT International Application No. PCT/FI2007/000141 filed on May 24, 2007, which designated the United States, and on which priority is claimed under 35 U.S.C. §120. This application also claims priority under 35 U.S.C. §119(a) on patent application Ser. No(s). 20060511 filed in Finland on May 24, 2006. The entire contents of each of the above documents is hereby incorporated by reference.

FIELD OF THE INVENTION

The present invention relates to a method as defined in the preamble of claim 1. In addition, the present invention relates to a system as defined in the preamble of claim 11.

BACKGROUND OF THE INVENTION

A prior art method for installing the guide rails, such as the car guide rails and/or counterweight guide rails, of an elevator in the elevator shaft or similar. In the prior art method, to which reference is made in the description of the prior art in publication U.S. Pat. No. 6,422,352, the guide rails are installed by assembly in stages, starting from the bottom of the elevator shaft, by placing guide rail sections that are shorter than the whole length of the guide rail one consecutively after the other and by aligning the guide rail sections vertically by means of a perpendicular laser beam produced by a direction laser. In addition it has been necessary to use plumb lines suspended from the machine room above the shaft, from floor levels or a from separate scaffold. Likewise a prior art system for assembling guide rails in the elevator shaft from consecutive guide rail sections, which system comprises a direction laser, which produces a perpendicular laser beam for aligning the guide rail sections.

In prior art high-precision lasers are used with long distances as a direction laser, the shaped laser beam produced by which is intended to remain as a distinct narrow bunch over a long distance, so that it can be utilized in installation for the entire length of the elevator shaft.

The use of lasers in installing elevator guide rails is not widespread because the dust hanging in the air of the elevator shaft is a problem, due to which the laser beam bunch disperses over a long distance and does not achieve a distinct round lighting point, by means of which accurate alignment can be performed. Another problem is that long-distance lasers are quite expensive in price and large in size. The accuracy of a plumb line, for its part, is affected by air currents and temperature fluctuations.

PURPOSE OF THE INVENTION

The purpose of the invention is to eliminate at least part of the aforementioned drawbacks.

In particular, a purpose of the invention is to disclose a method that enables the use of inexpensive direction lasers in the installation of guide rails, such that environmental conditions do not affect the alignment accuracy of the guide rails.

Another purpose of the invention is to disclose a system for implementing the method.

SUMMARY OF THE INVENTION

The method and the system according to the invention are characterized by what is disclosed in the characterization parts of claims 1 and 11. Other embodiments of the invention are characterized by what is disclosed in the other claims. Some inventive embodiments are also discussed in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the scope of the basic inventive concept in conjunction with other embodiments.

According to the invention the direction laser is moved upwards along with progressive assembly of the guide rail, and as assembly progresses the direction laser is supported on a fixed structure of the elevator shaft, such as on the wall of the elevator shaft or on a fixing element secured to the wall of the elevator shaft, in the proximity of the top end of each topmost perpendicularly aligned guide rail section for alignment of the next guide rail section to be installed in the vertical direction. These phases are repeated until the entire guide rail is assembled.

It has been observed that if the direction laser is supported on a fixed structure, such as on the wall of the elevator shaft or on a structure of it, which is essentially immovable with respect to the wall of the elevator shaft or similar, installation of the guide rails is possible with few vibration problems. What is essential is that the fixing point is secure in the way that the direction laser is essentially not subjected to e.g. vibrations caused in the guide rail installation work. If the direction laser were fixed to a guide rail subjected to vibration, it would cause problems of vibration of the direction laser. Vibration is caused by, among other things, impacts on the lower guide rails occurring in connection with installation of the upper guide rails. In this case the use of an automatically perpendicular laser beam becomes awkward because such a device is very sensitive to vibration owing to its operating principle. After a vibration the return of the operating ability of the device takes time, in which case repetitive vibration can remove the operating ability in practice almost completely. One advantage of the invention is that a lightweight and inexpensive laser can be used as a direction laser. As a result of the invention it is sufficient that the bunch of beams remains narrow and distinct and produces a round, point-form lighting pattern over a relatively short distance.

In one embodiment of the method a self-leveling construction measuring laser is used as a direction laser, which forms an automatically perpendicular laser beam.

In one embodiment of the method a) a plurality of fixing elements for fixing the guide rails are fixed to the vertical wall of the elevator shaft or to a similar solid structure b) an alignment appliance, which contains an aligning element, is fixed to the guide rail section to be aligned at a distance from the direction laser, c) the guide rail section to be aligned is moved in the lateral direction so that the aligning element faces the laser beam, and d) the guide rail section to be aligned is fixed to the fixing element.

In one embodiment of the method the alignment appliance is fixed to the guide rail section at a point that is in the proximity of the fixing element of the guide rail section to be fixed at that time.

In one embodiment of the method e) the direction laser is placed at the bottom of the elevator shaft for aligning the bottommost guide rail section.

f) the alignment appliance is fixed to the bottommost guide rail section in the proximity of the bottommost fixing element, g) the guide rail section to be aligned is moved in the lateral direction so that the aligning element faces the laser beam, h) the guide rail section is fixed to the fixing element i) the alignment appliance is removed and the alignment appliance is fixed in the proximity of the next higher fixing elements j) phases g)-i) are repeated until the entire bottommost guide rail section is aligned and fixed to the fixing elements, k) the alignment appliance is left in place in the proximity of the top end of the bottommost guide rail section, l) the direction laser is moved from the bottom of the elevator shaft upwards and connected to a fixed structure in the proximity of the alignment appliance that is disposed in the proximity of the top end of the bottommost guide rail section, and m) the direction laser is moved in the lateral direction so that the laser beam hits the aligning element of the alignment appliance left in the proximity of the top end of the bottommost guide rail section, and the direction laser is fixed in position with respect to the bottommost guide rail section.

In one embodiment of the method n) the alignment appliance is removed from the guide rail section that is lower at that time and the alignment appliance is moved upwards to the proximity of the bottommost fixing element of the next guide rail section to be aligned, o) the guide rail section to be aligned is moved so that the aligning element faces the laser beam, p) the guide rail section is fixed to the fixing element, q) the alignment appliance is removed and the alignment appliance is fixed in the proximity of the next higher fixing element, r) phases o)-q) are repeated until the entire guide rail section is aligned and fixed to the fixing elements, s) the alignment appliance is left in place in the proximity of the top end of the guide rail section, t) the direction laser is moved upwards and connected to a fixed structure in the proximity of the alignment appliance that is disposed in the proximity of the top end of the aligned guide rail section, and u) the direction laser is directed by means of the alignment appliance left in the proximity of the top end of the guide rail section so that the laser beam hits the aligning element of the alignment appliance, and the direction laser is fixed in place, v) phases n)-u) are repeated until the entire guide rail is assembled.

In one embodiment of the method, in phase t) the direction laser is moved upwards by a distance interval, which is preferably in the order of magnitude of 10 meters. The distance interval can in fact be greater or smaller than this.

In one embodiment of the method the guide rails are assembled from the bottom upwards as pairs of guide rail sections.

In one embodiment of the method it is ensured, by means of an alignment plumb line extending between the alignment appliances connected to the first and second guide rail sections and of alignment marks on the alignment appliances, that the first and second guide rail section of the guide rail pairs, which comprise a first guide rail section and a second guide rail section diametrically opposite to each other, are in the pre-defined correct position both with respect to each other and to the vertical and horizontal planes when the alignment plumb line is at the point of the first and the second alignment mark. It is possible thus to ensure that the guide rail sections are not e.g. twisted around their vertical axes.

In one embodiment of the method the direction laser is supported on a fixed structure of the elevator shaft via a support device. In this way the direction laser can be fixed to a fixed structure of the elevator shaft and simultaneously extend to the proximity of the guide rails for the purpose of alignment. The support device is preferably a rod-like fixing element, which is preferably formed to be adjustable, in which case the direction laser can be positioned in exactly the desired place and positioning is easy to perform. The direction laser can thus be kept separate from the guide rails and excessive vibration is avoided.

The system according to the invention comprises an alignment appliance. The alignment appliance comprises a frame, which contains a detent, which can be supported against the guide rail section. A permanent magnet is fixed to the frame in the proximity of the detent for fixing the frame to the guide rail section. In addition the alignment appliance contains an aligning element, at which the laser beam produced by the direction laser can be directed. The aligning element of the alignment appliance can with the arrangement be accurately positioned with respect to the detent. By means of the magnet the guide rail can be positioned against the detent almost without a clearance. The system also comprises a support device for supporting the direction laser on a fixed structure, such as on the wall of the elevator shaft or on a fixing element securely fixed to the wall of the elevator shaft. The direction laser can thus be kept separate from the guide rails and excessive vibration is avoided. The support device is preferably formed to be adjustable, in which case the direction laser can be positioned very accurately.

In one embodiment of the system the magnet is on the side of the base of the slot incorporated in the alignment appliance and arranged to pull the guide rail towards the base of the slot or recess of the alignment appliance. In this way it is possible to ensure good repeatability of the positioning between the alignment appliance and the guide rail. Alternatively the magnet can be installed to the side of the slot to pull the guide rail and the alignment appliance towards each other in the lateral direction. In yet another embodiment of the system the alignment appliance comprises a magnet at the base of and on the side of the slot or recess of the alignment appliance so that the magnet attracts the guide rail in two directions.

In one embodiment of the system the system comprises an alignment plumb line, which is fixed at its first end to the first alignment appliance, which can be fixed to the first guide rail section. The alignment plumb line is fixed at its second end to a second alignment appliance, which can be fixed to the diametrically opposite second guide rail section. The second alignment appliance is in shape an identical mirror image of the first alignment appliance. The first alignment mark is on the first alignment appliance at a distance from the first end of the alignment plumb line. Correspondingly the second alignment mark is on the second alignment appliance at a distance from the second end of the plumb line. The first and the second guide rail section are in the pre-defined correct position both with respect to each other and to the vertical and horizontal planes when the alignment plumb line is at the point of the first alignment mark and the second alignment mark. It is possible thus to ensure that the guide rail sections are not twisted around their vertical axes.

In one embodiment of the system the system comprises one direction laser for each guide rail to be assembled.

In some embodiments of the method and of the system the fixed structure is the wall of the elevator shaft or similar structure of the elevator shaft or a beam securely fixed to the elevator shaft or a fixing element of the guide rail. A fixed structure can be e.g. a part of the framework of the elevator shaft or similar.

LIST OF FIGURES

Figure 2:
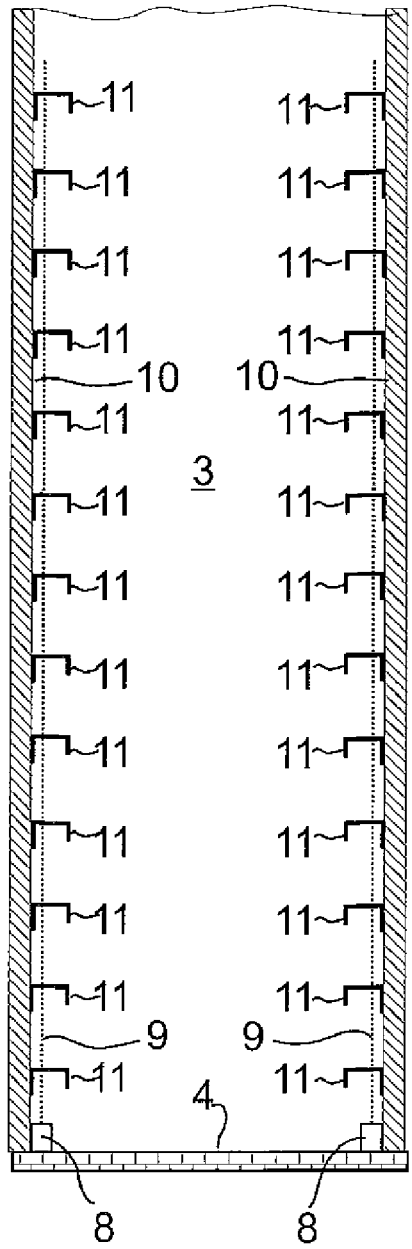
Figure 3:
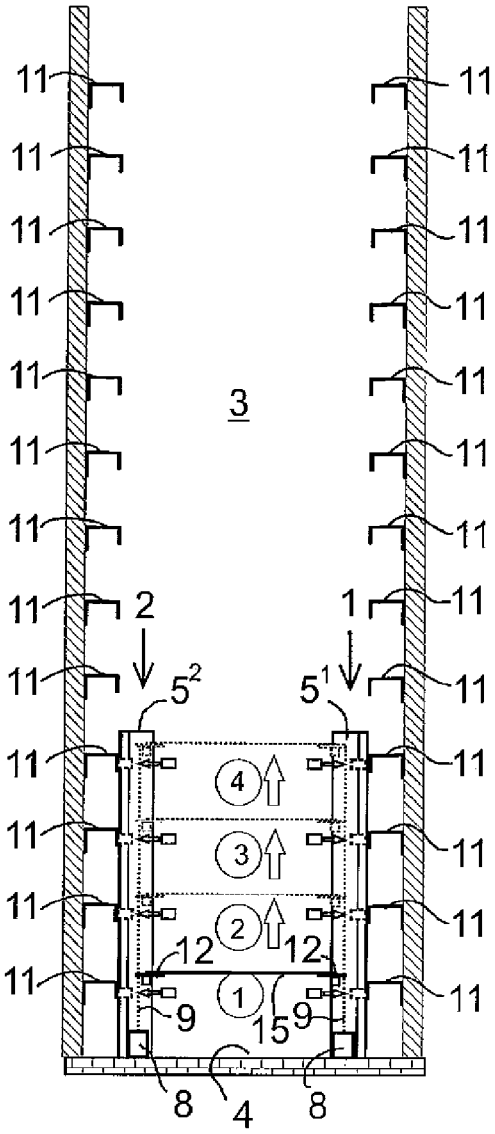
Figure 4:
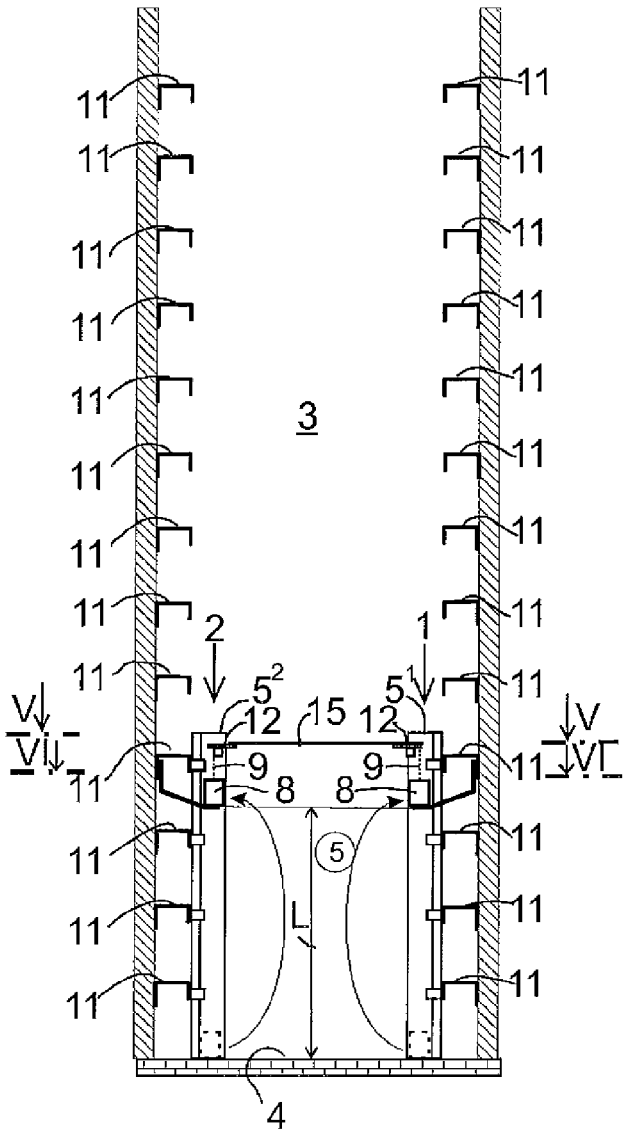
Figure 5:
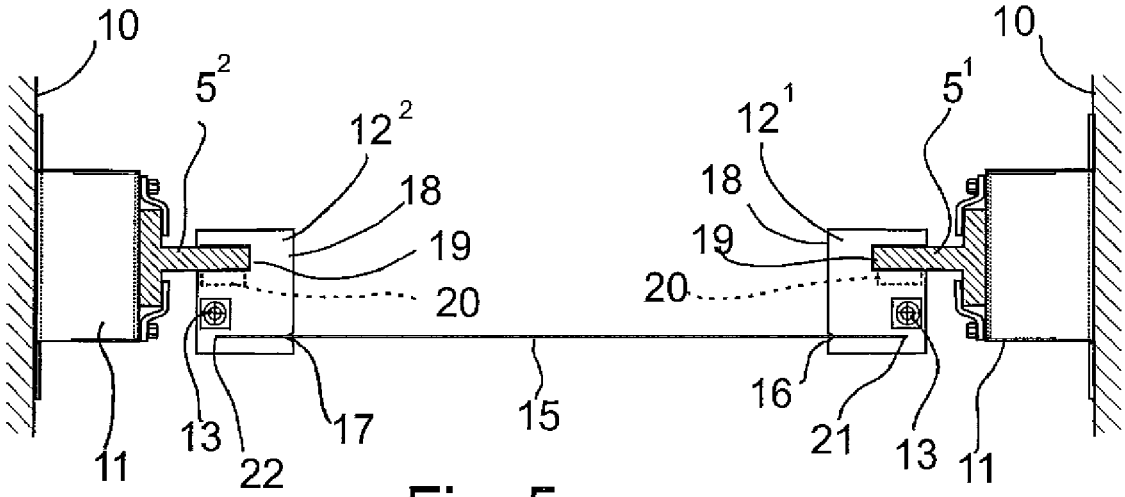
Figure 6:
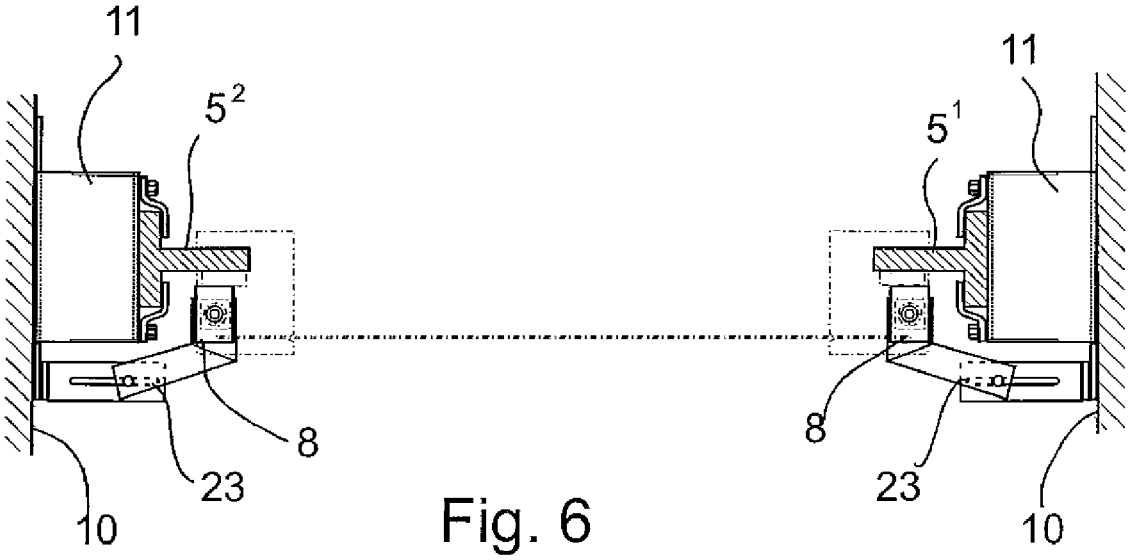
Figure 9:
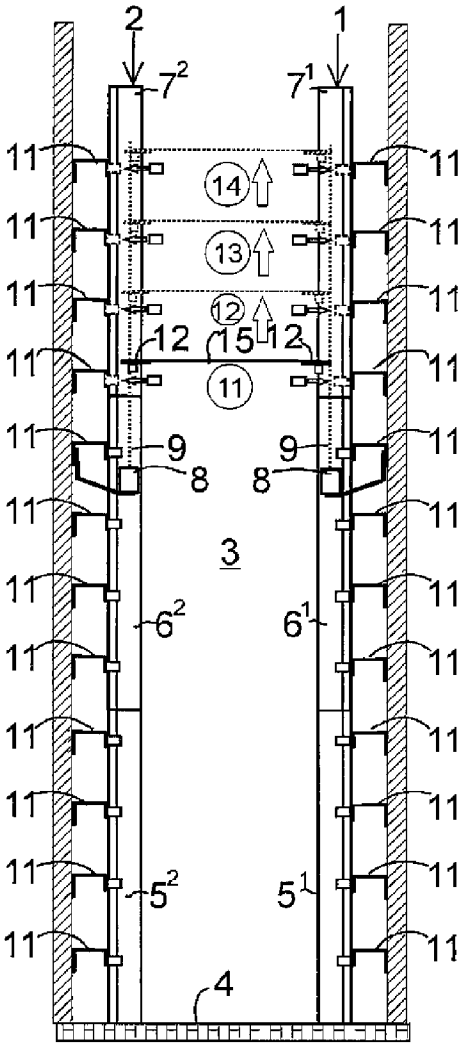

In the following, the invention will be described in detail by the aid of a few examples of its embodiments with reference to the attached drawings, wherein FIGS. 1-4 and 7-9 diagrammatically present the different phases of assembly of the guide rails in the elevator shaft with a manner according to one embodiment of the method according to the invention, FIG. 5 presents a V-V section of FIG. 4, and FIG. 6 presents a VI-VI section of FIG. 4.

DETAILED DESCRIPTION OF THE INVENTION

FIG. 1 shows a longitudinal cross-section of an elevator shaft and in the figure is a II-II section of FIG. 1. FIGS. 1 and 2 illustrate the preliminary phase before the actual assembly of the guide rails, in which a plurality of fixing elements 11, to which the guide rails of the car and/or counterweight are intended to be fixed, are initially fixed to the vertical walls of the elevator shaft 3. It should be noted that in FIGS. 1-4 and 7-9 the relative distance between the fixing elements 11 has been reduced in the vertical direction to be substantially smaller than the actual situation to facilitate illustration and drawing technique.

The installation and alignment of the fixing elements 11 can be performed with any conventional method whatsoever, such as e.g. with plumb lines. In this example, however, the same direction lasers 8 that are used in the method according to the invention are utilized. Preferably a self-leveling construction measuring laser is used as the direction laser 8, which automatically forms a perpendicular laser beam 9. The direction lasers 8 are placed at the bottom 4 of the elevator shaft 3 by measuring with a measuring rod 24 their position from the front wall of the elevator shaft. Fixing holes are drilled on the same vertical line in the vertical wall 10 of the elevator shaft for the fixing elements 11 by means of the laser beam 9. The fixing bolts of the fixing elements 11 are installed in these holes and are positioned to be horizontal using a conventional spirit level 25 as an aid. In this way all the fixing elements 11 are installed for the whole length of the elevator shaft 3.

Generally in the method of FIGS. 1-4, 7-9 the guide rails 1,2 are installed by assembly in phases, starting from the bottom 4 of the elevator shaft, by placing one on top of the other guide rail sections $\mathbf{5}^1$, $\mathbf{5}^2$; $\mathbf{6}^1$, $\mathbf{6}^2$; $\mathbf{7}^1$, $\mathbf{7}^2$ that are shorter than the whole length of the guide rail. This is performed with pairs of guide rail sections. The guide rails 1, 2 are assembled in the guide rail section pairs $\mathbf{5}^1$, $\mathbf{5}^2$; $\mathbf{6}^1$, $\mathbf{6}^2$; $\mathbf{7}^1$, $\mathbf{7}^2$ . . . from the bottom upwards.

The guide rail sections are aligned vertically by means of the perpendicular laser beams 9 produced by the direction lasers 8. The direction lasers 8 are moved upwards along with progressive assembly of the guide rails 1, 2. The direction laser is supported in the proximity of the top end of the topmost vertically aligned guide rail section at the time for aligning the next guide rail section to be installed in the vertical direction, and these phases are repeated until the entire guide rail 1, 2 is assembled. In the figures the direction laser 8 is supported on the fixing element 11. Supporting the direction laser 8 on the wall 10 of the elevator shaft can be implemented in a similar manner. Fixing the support device 23 of the direction laser on a fixed structure of the elevator shaft can be performed with some prior art method, such as with a screw fixing, with a magnet or by welding.

As can be seen in FIGS. 5 and 6, to facilitate the alignment an alignment appliance 12, which contains an aligning element 13, is fixed to the guide rail section $\mathbf{5}^1$, $\mathbf{5}^2$; (and also $\mathbf{6}^1$, $\mathbf{6}^2$; $\mathbf{7}^1$, $\mathbf{7}^2$ etc) to be aligned at a distance from the direction laser 8. The guide rail section $\mathbf{5}^1$, $\mathbf{5}^2$ to be aligned is moved in the lateral direction so that the aligning element 13 faces the laser beam 9, after which the guide rail section $\mathbf{5}^1$, $\mathbf{5}^2$ to be aligned can be fixed to the fixing element 11. The alignment appliance 12 is always fixed to a point of the guide rail section $\mathbf{5}^1$, $\mathbf{5}^2$ that is in the proximity of the fixing element 11 to be fixed at that time to the guide rail section.

FIG. 3 presents the installation and alignment of the bottommost pair of guide rail sections $\mathbf{5}^1$, $\mathbf{5}^2$ by means of the laser beams 9 of the direction lasers 8. To align the bottommost guide rail section $\mathbf{5}^1$, $\mathbf{5}^2$ the direction laser 8 is placed at the bottom 4 of the elevator shaft 3 beside the bottommost guide rail section. Then the alignment appliance 12 is fixed to the bottommost guide rail section $\mathbf{5}^1$, $\mathbf{5}^2$ in the proximity of the bottommost fixing element 11, which is described in phase 1 (the FIG. 1 inside a circle) of FIG. 1.

The guide rail section $\mathbf{5}^1$, $\mathbf{5}^2$ is moved in the lateral direction so that the aligning element 13 faces the laser beam 9, after which the guide rail section $\mathbf{5}^1$, $\mathbf{5}^2$ can be fixed securely to the fixing element 11. In phase 2 the alignment appliance 12 is in the proximity of the next higher fixing element 11. The phases are repeated, as is illustrated with the circled numbers 2, 3 and 4, for each fixing element 11 until the entire bottommost guide rail section $\mathbf{5}^1$, $\mathbf{5}^2$ is aligned and fixed to the fixing elements 11. The alignment appliance 12 is left in place in the proximity of the top end of the bottommost guide rail section $\mathbf{5}^1$, $\mathbf{5}^2$ when the direction laser 8 is moved from the bottom 4 of the elevator shaft upwards and connected to a fixed structure in the proximity of the alignment appliance 12 that is disposed in the proximity of the top end of the bottommost guide rail section $\mathbf{5}^1$, $\mathbf{5}^2$, which phase 5 (FIG. 5 inside a circle) presents in FIG. 4. The direction laser 8 is moved upwards by the distance interval L, which is e.g. in the order of magnitude of approx. 10 meters. Then the direction laser 8 is aligned with the previous vertical line such that the direction laser 8 is adjusted in the lateral direction so that the laser beam 9 hits the aligning element 13 of the alignment appliance 12 left in the proximity of the top end of the bottommost guide rail section 51, 52, and the direction laser 8 is fixed in position with respect to the bottommost guide rail section.

Figure 8:
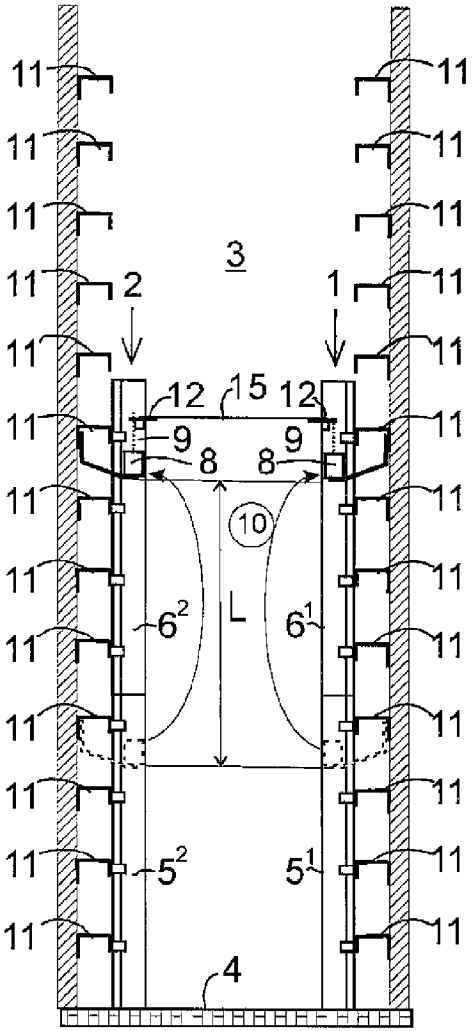
Figure 7:
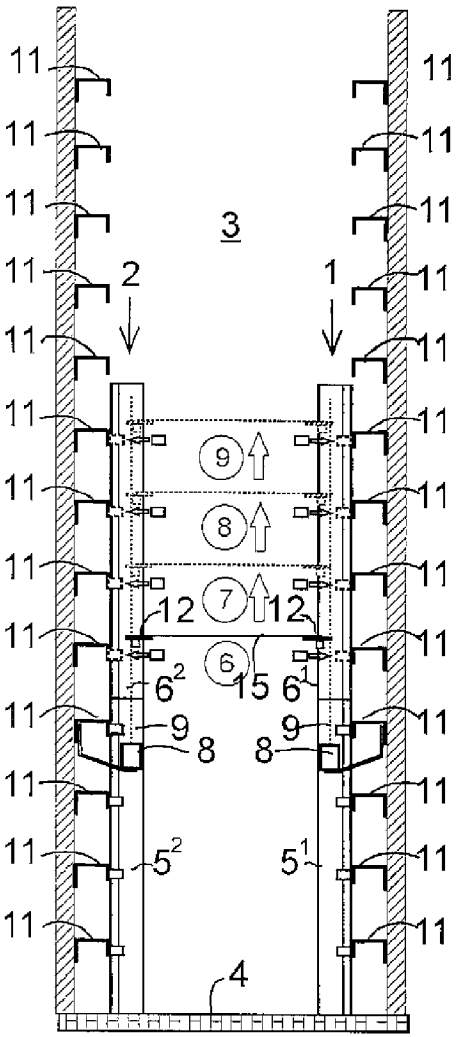

The alignment appliance 12 in FIG. 7 is removed from the lower guide rail section $\mathbf{5}^1$, $\mathbf{5}^2$ and the alignment appliance 12 is moved upwards to the proximity of the bottommost fixing element 11 of the next guide rail section $\mathbf{6}^1$, $\mathbf{6}^2$ to be aligned. The guide rail section $\mathbf{6}^1$, $\mathbf{6}^2$ to be aligned is moved so that the aligning element 13 faces the laser beam 9. The guide rail section is fixed to the fixing element 11. The alignment appliance 12 is removed and fixed in the proximity of the next higher fixing element 11. The phases are repeated, as is illustrated with the circled numbers 6, 7, 8 and 9, for each fixing element 11 until the entire guide rail section $\mathbf{6}^1$, $\mathbf{6}^2$ is aligned and fixed to the fixing elements 11. Again the alignment appliance 12 is left in place in the proximity of the top end of the bottommost guide rail section $\mathbf{6}^1$, $\mathbf{6}^2$ when the direction laser 8 is moved by the amount of the distance interval L, which is preferably in the order of magnitude of approx. 10 meters, and connected to a fixed structure in the proximity of the alignment appliance 12 that is disposed in the proximity of the top end of the aligned guide rail section. In a similar manner to what is presented in FIG. 4, also the direction laser 8 in FIG. 8 is directed by means of the alignment appliance 12 left in the proximity of the top end of the guide rail section $6^1$, $6^2$ so that the laser beam hits the aligning element 13 of the alignment appliance, and the direction laser 8 is fixed in place. As FIG. 9 further illustrates, the corresponding phases are repeated until the entire guide rail 1, 2 is assembled to completion.

As can be seen from the figures, the guide rail section pairs comprise a first guide rail section $5^1$ (and further $6^1$, $7^1$ . . . ) and a second guide rail section $5^2$ (and further $6^2$, $7^2$ . . . ) that are diametrically opposite to each other. By means of the alignment plumb line 15 extending between the alignment appliances 12 connected to the first and to the second guide rail section and of the alignment marks 16, 17 on the alignment appliances, it is ensured that the guide rail sections in the guide rail section pair are on the same vertical plane e.g. after fixing one guide rail section and before fixing a second guide rail section.

Referring again to FIGS. 5 and 6, the alignment appliance 12 comprises a frame 18, which contains a detent 19, such as an edge, a recess or a U-shaped slot, as in the figures, which can be supported against the guide rail section $5^1$, $5^2$ (and further $6^1$, $6^2$; $7^1$, $7^2$ . . . ). The permanent magnet 20 is fixed to the frame 18 in the proximity of the detent 19 for fixing the frame 18 to the guide rail section $5^1$, $5^2$ (and further $6^1$, $6^2$; $7^1$, $7^2$ . . . ). On the frame is an aligning element 13, at which the laser beam 9 produced by the direction laser 8 can be directed. The aligning element 13 can be e.g. a window, in which is an alignment grid or similar, on which the laser beam 9 forms a lighting point.

As can be seen from FIG. 5, the alignment plumb line 15 is fixed at its first end 21 to the first alignment appliance $12^1$, which can be fixed to the first guide rail section $5^1$ (and further $6^1$, $7^1$), and which alignment plumb line is fixed at its second end 22 to the second alignment appliance $12^2$, which can be fixed to the diametrically opposite second guide rail section $5^2$ (and further $6^2$, $7^2$ . . . ). The second alignment appliance $12^2$ is in shape an identical mirror image of the first alignment appliance $12^1$. The first alignment mark 16 is on the first alignment appliance $12^1$ at a distance from the first end 21 of the alignment plumb line 15. The second alignment mark 17 is on the second alignment appliance $12^2$ at a distance from the second end 22 of the alignment plumb line 15. The first and second guide rail section are in the pre-defined correct position both with respect to each other and to the vertical and horizontal planes when the alignment plumb line is at the point of the first alignment mark 16 and the second alignment mark 17. It is possible thus to ensure that the diametrically opposite guide rail sections are not twisted around their vertical axes.

FIG. 6 also shows an adjustable support device 23, with which the position of the direction laser 8 fixed to the support device can be adjusted and supported on a fixed structure (10, 11). The fixed structure can be the wall of the elevator shaft or similar structure of the elevator shaft or a beam securely fixed to the elevator shaft or a fixing element of the guide rail. The fixed structure can be e.g. a part of the framework of the elevator shaft or similar. An adjustable structure can be the structure presented in FIG. 6, in which the support device extends from its fixing point to the proximity of the guide rail and comprises parts that are movable with respect to each other, which can be tightened into the desired position e.g. with a screw fixing.

It is obvious to the person skilled in the art that the invention is not limited to the embodiments described above, in which the invention is described using examples, but that many adaptations and different embodiments of the invention are possible within the scope of the inventive concept defined by the claims presented below.

LIST OF REFERENCE NUMBERS guide rail (1, 2)
elevator shaft (3)
bottom (4)
guide rail section ($5^1$, $5^2$; $6^1$, $6^2$; $7^1$, $7^2$ . . . )
bottommost guide rail section ($5^1$, $5^2$)
consecutive guide rail section ($6^1$, $6^2$; $7^1$, $7^2$ . . . )
direction laser (8)
laser beam (9)
vertical wall (10)
fixing element (11)
alignment appliance (12)
aligning element (13)
bottom (14)
distance interval (L)
first guide rail section ($5^1$, $6^1$, $7^1$)
second guide rail section ($5^2$, $6^2$, $7^2$)
alignment plumb line (15)
alignment mark (16, 17)
first alignment mark (16)
second alignment mark (17)
frame (18)
detent (19)
permanent magnet (20)
first end (21)
second end (22)
support device (23)
measuring rod (24)
spirit level (25)

The invention claimed is:

1. A method for installing guide rails, such as car guide rails and/or counterweight guide rails, in an elevator shaft or similar structure, said method comprising the steps of:

installing the guide rails by assembly in phases starting from the bottom of the elevator shaft by placing one on top of the other guide rail sections that are shorter than the whole length of the guide rail and by aligning the guide rail sections perpendicularly by means of a laser beam produced by a direction laser;

moving the direction laser upwards along with progressive assembly of the guide rail;

as assembly progresses, supporting the direction laser on a fixed structure of the elevator shaft, the fixed structure being the wall of the elevator shaft or a fixing element securely fixed to the wall of the elevator shaft, in the proximity of the top end of each topmost perpendicularly aligned guide rail section for alignment of the next guide rail section to be installed in the vertical direction; and repeating the steps of installing, moving and supporting until the whole guide rail is assembled.

2. The method according to claim 1, further comprising the step of using a self-leveling construction measuring laser as the direction laser, which forms an automatically perpendicular laser beam.

3. The method according to claim 1, further comprising the steps of:

fixing a plurality of fixing elements for fixing the guide rails to the vertical wall of the elevator shaft or to a similar solid structure;

fixing an alignment appliance, which contains an aligning element, to the guide rail section to be aligned, at a distance from the direction laser;

moving the guide rail section to be aligned in the lateral direction so that the aligning element faces the laser beam; and fixing the guide rail section to be aligned to the fixing element.

4. The method according to claim 3, further comprising the step of fixing the alignment appliance to a point of the guide rail section which is in the proximity of the fixing element of the guide rail section to be fixed at that time.

5. The method according to claim 3, further comprising the steps of:

placing the direction laser at the bottom of the elevator shaft for aligning the bottommost guide rail section;

fixing the alignment appliance to the bottommost guide rail section in the proximity of the bottommost fixing element;

moving the guide rail section in the lateral direction so that the aligning element faces the laser beam;

fixing the guide rail section to the fixing element;

removing the alignment appliance and fixing the alignment appliance in the proximity of the next higher fixing element;

repeating the steps of moving and fixing the guide rail section and removing the alignment appliance and fixing the alignment appliance until the entire bottommost guide rail section is aligned and fixed to the fixing elements;

leaving the alignment appliance in place in the proximity of the top end of the bottommost guide rail section;

moving the direction laser from the bottom of the elevator shaft upwards and connecting the direction laser to a fixed structure in the proximity of the alignment appliance that is disposed in the proximity of the top end of the bottommost guide rail section; and moving the direction laser in the lateral direction so that the laser beam hits the aligning element of the alignment appliance left in the proximity of the top end of the bottommost guide rail section, and fixing the direction laser in position with respect to the bottommost guide rail section.

6. The method according to claim 5, further comprising the steps of:

removing the alignment appliance from the guide rail section that is lower at that time and moving the alignment appliance upwards to the proximity of the bottommost fixing element of the next guide rail section to be aligned;

moving the guide rail section to be aligned so that the aligning element faces the laser beam;

fixing the guide rail section to the fixing element;

removing the alignment appliance and fixing the alignment appliance in the proximity of the next higher fixing element;

repeating the steps of moving and fixing the guide rail section and removing and fixing the alignment appliance until the entire guide rail section is aligned and fixed to the fixing elements;

leaving the alignment appliance in place in the proximity of the top end of the guide rail section;

moving the direction laser upwards and connecting the direction laser to a fixed structure in the proximity of the alignment appliance that is disposed in the proximity of the top end of the aligned guide rail section;

directing the direction laser by means of the alignment appliance left in the proximity of the top end of the guide rail section so that the laser beam hits the aligning element of the alignment appliance, and fixing the direction laser in place; and repeating the above steps until the entire guide rail is assembled.

7. The method according to claim 6, further comprising the step of moving the direction laser upwards by the distance interval (L), which is in the order of magnitude of approx. 10 meters.

8. The method according to claim 1, further comprising the step of assembling the guide rails in guide rail section pairs from the bottom upwards.

9. The method according to claim 1, further comprising the step of ensuring, by means of an alignment plumb line extending between the alignment appliances connected to the first and second guide rail sections of the guide rail pairs and of alignment marks on the alignment appliances, that the guide rail section pairs, which comprise a first guide rail section and a second guide rail section diametrically opposite to each other, are in the pre-defined correct position with respect to each other after the fixing of the first guide rail section and before the fixing of the second guide rail section.

10. The method according to claim 1, wherein the fixed structure is the wall of the elevator shaft or similar structure of the elevator shaft or a beam securely fixed to the elevator shaft or a fixing element of the guide rail.

11. A system for installing guide rails, such as car guide rails and/or counterweight guide rails, in an elevator shaft from consecutive guide rail sections, comprising:

at least one direction laser, which produces a perpendicular laser beam for aligning the guide rail sections;

a support device for supporting the direction laser on a fixed structure; and an alignment appliance, said alignment appliance comprising:

a frame, which contains a detent, which can be supported against the guide rail section;

a permanent magnet, which is fixed to the frame in the proximity of the detent for fixing the frame to the guide rail section; and an aligning element, at which a laser beam produced by the direction laser can be directed, wherein the fixed structure on which the direction laser is supported is the wall of the elevator shaft or a fixing element securely fixed to the wall of the elevator shaft.

12. The system according to claim 11, wherein the system further comprises;

an alignment plumb line, which is fixed at a first end thereof to the first alignment appliance, which can be fixed to the first guide rail section, and which alignment plumb line is fixed at a second end thereof to the second alignment appliance, which can be fixed to the diametrically opposite second guide rail section, and which second alignment appliance is in shape an identical mirror image of the first alignment appliance;

a first alignment mark, which is on the first alignment appliance at a distance from the first end of the alignment plumb line; and a second alignment mark on the second alignment appliance at a distance from the second end of the alignment plumb line, in which case the first and the second guide rail section are in the pre-defined correct position both with respect to each other and to the vertical and horizontal planes when the alignment plumb line is at the point of the first alignment mark and the second alignment mark.

13. The system according to claim 11, wherein the support device is adjustable for positioning the direction laser.

14. A method for installing guide rails, such as car guide rails and/or counterweight guide rails, in an elevator shaft or similar structure, said method comprising the steps of:

installing the guide rails by assembly in phases starting from the bottom of the elevator shaft by placing one on top of the other guide rail sections that are shorter than the whole length of the guide rail and by aligning the guide rail sections perpendicularly by means of a vertical laser beam produced by a direction laser;

moving the direction laser upwards along with progressive assembly of the guide rail;

as assembly progresses, supporting the direction laser in the proximity of the top end of each topmost perpendicularly aligned guide rail section for alignment of the next guide rail section to be installed in the vertical direction; and repeating the steps of installing, moving and supporting until the whole guide rail is assembled.

15. The method according to claim 14, further comprising the steps of using an adjustable support device, to adjust and support the position of the direction laser fixed to the support device, the adjustable support device comprising parts that are movable with respect to each other, which can be tightened into the desired position.

16. The method according to claim 15, wherein the parts that can be tightened into the desired position are fixed with screws.

17. The method according to claim 14, further comprising using a self-leveling laser as the direction laser, which forms an automatically perpendicular laser beam.

18. A system for installing guide rails in an elevator shaft from consecutive guide rail sections, comprising:

at least one direction laser, which produces a laser beam for aligning the guide rail sections;

a support device for supporting the at least one direction laser; and an alignment appliance, said alignment appliance comprising:

a frame, which can be supported and fixed against a guide rail section;

a detent formed in the frame, the detent configured to receive a portion of the guide rail section;

a magnet attached to the frame, the magnet being adjacent to the detent; and an aligning element, at which a laser beam produced by the at least one direction laser can be directed, wherein the support device for supporting the at least one direction laser includes two arms that are moveable relative to one another.

19. The system according to claim 18, wherein the support device is adjustable to adjust the position of the direction laser fixed to the support device, the support device comprising parts that are movable with respect to each other, which can be tightened into a desired position.

20. The system according to claim 19, wherein the parts that can be tightened into the desired position are fixed with screws.

21. The system according to claim 19, wherein the support device can support the direction laser in the proximity of the top end of a perpendicularly aligned guide rail section for alignment of the next guide rail section to be installed in the vertical direction.

* * * * *